United States Patent [19]

Harris

[11] 4,040,224

[45] Aug. 9, 1977

[54] ROOF INSULATION SUPPORT MEANS

[75] Inventor: Frank D. Harris, Homosassa Springs, Fla.

[73] Assignee: Ralph D. Harris, Margarita, CanalZone

[21] Appl. No.: 647,985

[22] Filed: Jan. 8, 1976

Related U.S. Application Data

[62] Division of Ser. No. 508,712, Sept. 23, 1974, abandoned.

[51] Int. Cl.[2] ..... E04C 1/24

[52] U.S. Cl. ..... 52/509; 52/364; 52/588; 85/11

[58] Field of Search ..... 52/509, 512, 370, 364, 52/377, 373, 367, 484, 588; 85/11, 28

[56] References Cited

U.S. PATENT DOCUMENTS

| | | | |
|---|---|---|---|
| 2,476,506 | 7/1949 | Olsen | 52/364 |
| 2,895,432 | 7/1959 | Bowman | 52/373 |
| 3,282,005 | 11/1966 | Birdwell | 52/364 |
| 3,499,359 | 3/1970 | Yrjanainen | 85/11 |
| 3,511,127 | 5/1970 | Gisondi | 85/11 |
| 3,608,263 | 9/1971 | Gartner | 52/484 |
| 3,792,560 | 2/1974 | Naylor | 52/364 |

FOREIGN PATENT DOCUMENTS

| | | | |
|---|---|---|---|
| 493,122 | 5/1950 | Belgium | 52/364 |
| 275,109 | 5/1951 | Switzerland | 52/377 |
| 453,059 | 9/1936 | United Kingdom | 52/370 |

*Primary Examiner*—Price C. Faw, Jr.
*Assistant Examiner*—Henry Raduazo
*Attorney, Agent, or Firm*—Cushman, Darby & Cushman

[57] ABSTRACT

An insulation retaining device for supporting insulation material against the underside of a roofing panel interconnected with an adjacent roofing panel comprises a tongue portion for insertion between a joint of the interconnecting panels and a lip portion connected to the tongue for supporting insulation material placed against the underside of a panel.

4 Claims, 4 Drawing Figures

Fig. 1.
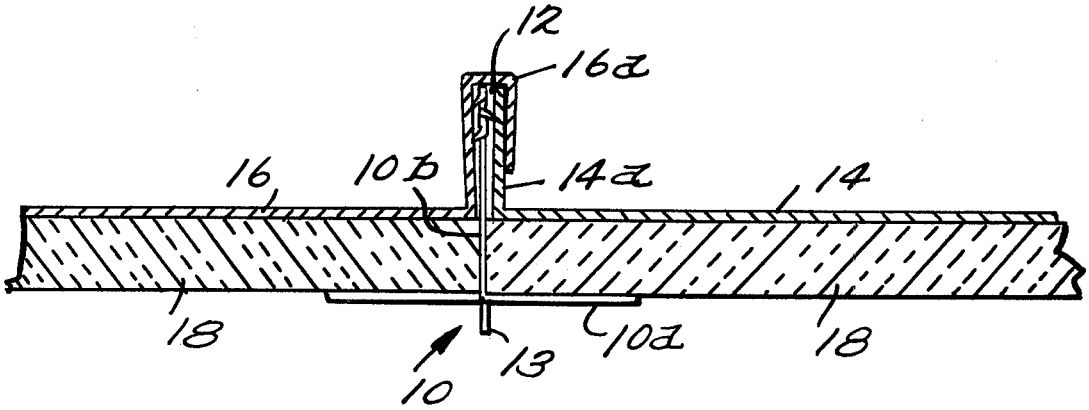
Fig. 4.
Fig. 2.
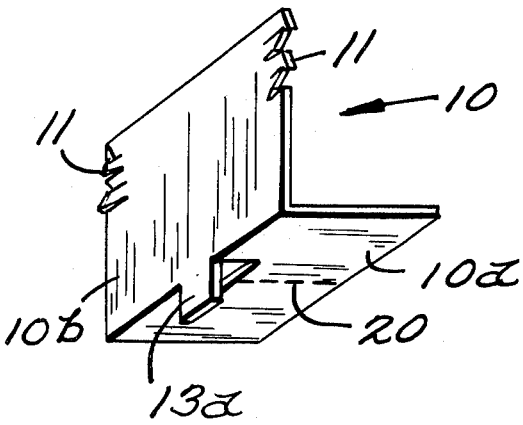
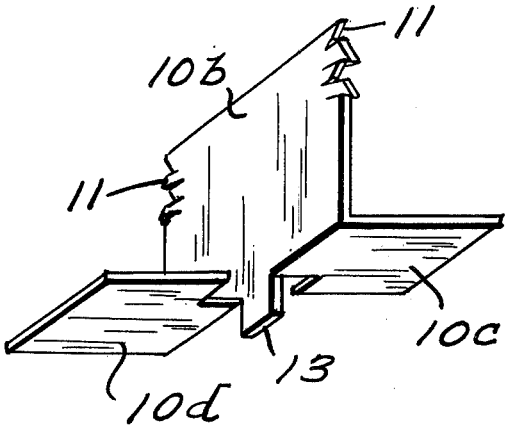
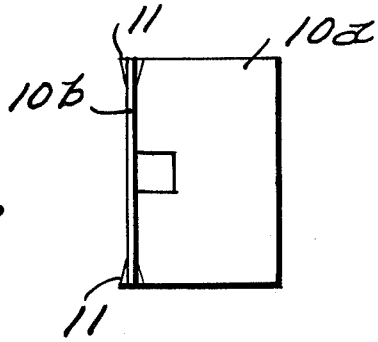
Fig. 3.

ROOF INSULATION SUPPORT MEANS

This is a division of application Ser. No. 508,712 filed Sept. 23, 1974 and now abandoned.

BACKGROUND OF THE INVENTION

Field of The Invention

The present invention relates to a means for supporting insulation against the underside of a roof. More specifically, the present invention is directed to supporting insulation against the underside of a portable roof adjunct such as a cabana or carport, etc.

The present invention finds particular use with adjuncts for mobile homes. Many mobile home owners set up cabanas as shelter for an outside porch. Such adjuncts are usually constructed of prefabricated, light-weight aluminum panels. These panels are commercially available in varying lengths and widths, so that a mobile home owner may construct a cabana which will cover a desired area. Typical panels use a tongue and groove construction so that they may be readily joined together. A light-weight frame is then employed to support the panels over the desired porch area.

A mobile home dweller having a cabana constructed of aluminum panels is well aware of the intense heat which may build up underneath the panels on a summer day. Various methods for providing insulation for cabanas have been suggested, but these insulation methods are generally permanent in nature and require a coating of the roof of the adjunct with roofing tar and paper or constructing a supporting frame work on the underside of the adjunct which is used to support a further ceiling structure. A particular disadvantage with these permanent insulating methods is that mobility of the structure is thereby sacrificed. Also, an aluminum panel roofing system may not have sufficient structural integrity to support permanent insulation.

The present invention is directed to the use of light-weight metal retaining supports which are inserted in a joint between adjacent aluminum panels. The support device of the present invention is L-shaped and utilizes a tongue portion inserted into the joint and the insulation is supported by a lip joined to the tongue. The number of retaining supports required for a given adjunct depends upon the size of the adjunct.

Insulation panels are typically available in corresponding or multiples of widths of the aluminum roofing panels. Aluminum roofing panels are typically narrow and light to facilitate easy handling. As the tongue portion of the retainer is inserted into the joint between two roof panels at appropriate intervals around the perimeter of the panels, the ceiling will bulge slightly upward. As pressure from the insertion is relaxed, the joint returns to its previous position holding the retainer. The desired insulation may then be inserted in the space between the lip of the retainer and the underside or the ceiling of the roofing panel.

SUMMARY OF THE INVENTION

It is therefore an object of the present invention to provide for a retaining means which will support insulation against the underside of roof panels of temporary adjuncts such as cabanas, canopies, carports or the like.

Another object of the present invention is to provide for a retaining means which may be readily inserted and removed between the joints of roof panels.

Another object of the present invention is to provide for a retaining means which enables temporary insulation to be secured against the underside of a roofing system so that permanent insulation need not be applied.

Yet a further object of the present invention is to provide for a retaining means which is light-weight and readily constructed so that insulation may be supported against the underside of a roof in an economical arrangement.

Additional objects of the present invention reside in the specific construction of the preferred embodiment hereinafter particularly described in the specification and shown in the several drawings.

BRIEF DESCRIPTION OF THE DRAWINGS

Novel features of the retaining means in accordance with the present invention will be more readily understood from the consideration of the following description taken together with the accompanying drawing, in which certain preferred adaptations are illustrated with the various parts thereof identified by suitable reference characters in each of the views,. and in which;

FIG. 1 is a cut taken along two interconnecting roof panels showing the retaining means inserted in the joint between the panels and supporting a board of insulation;

FIG. 2 is an isometric view of the retaining means taken along lines 2—2 of FIG. 1;

FIG. 3 is a top view of the retaining means of FIG . 2;

FIG. 4 is a second embodiment of the retaining means which contemplates the use of lip portions bent 180 degrees from each other.

DETAILED DESCRIPTION OF THE INVENTION

Referring now to FIG. 1, there is shown the retaining means 10 of the present invention inserted in a joint space 12 between interconnecting aluminum panels 14 and 16. Panel 14 is constructed with an upwardly extending projection or tongue **14*a*. Tongue 14*a* is inserted into a receiving groove formed within bentover portion 16*a* of panel 16.** Aluminum panels as above described are well-known and commonly used in the construction of carports and cabanas. They are of generally light-weight construction and may be purchased in lengths, widths and depths suitable for a particular area to be covered.

After the retaining means 10 has been inserted into joints 12 at appropriate locations, insulation boards 18 are inserted into the space between lip **10*a* and the bottom of panel 14 and 16. It has been found that insulation boards of polystyrene may be used advantageously. Additional retaining means 10 are inserted into the joint with lip portions 10*a* facing in alternating directions so that insulation boards are supported against both panels 14 and 16 and the other panels. Thus, insulation boards 18 are also supported under the complete roof structure. Additional retaining means 10 are likewise employed to support the opposite ends of insulation board 18** (not shown).

FIG. 2 is an isometric view taken along lines 2—2 of FIG. 1 and is illustrative of more detailed features of the retaining means 10. Retaining means 10 may be constructed of light-weight metal, i.e. 16, 18 or 20 gauge steel has been found to be most suitable. Disposed on opposite ends adjacent the top portion of tongue **10*b* are serrated edges 11. Edges 11 are constructed in the form of teeth which are alternately directed and point downward. Teeth or edges 11 provide for gripping resistance when tongue portion 10***b* is inserted into joint 12.

A tab 13 is punched from lip portion 10*a* and is bent downwardly in the same plane as tongue portion 10*b* to provide for a means for withdrawing retaining means 10 from joint 12. For instance, pliers could be used to grab onto tab 13. While alternating teeth 11 are contemplated, crimped edges could also provide the same function.

Serrated edges 11 need not be used if tongue portion 10*b* were provided with a slight arc. Such an arc would provide for resistance when tongue 10*b* is inserted into joint 12. Specifically, the arc would be slightly deformed and thereby exert a force against joint 12 when inserted therein. Also, the upper part of tongue 10*b* could be split to divide it into halves with each half slightly offset from the vertical. This construction would also enable the spring of the material to contact the sides of joint 12 and increase the resistance to withdrawal.

In FIG. 4 there is shown a second embodiment of the retaining means 10 wherein lip portion 10*a* has been cut along dotted line 20 (see FIG. 3). Lip segment 10*d* is then bent 180° from lip portion 10*c*. The advantage to the construction as illustrated in FIG. 4 is that alternating retaining means 10 need not be used but rather the embodiment of FIG. 4 provides for support of insulation boards 18 on either side of tongue 10*b*.

In a preferred embodiment, the retaining means 10 of the present inventon is constructed of 20 gauge steel, $1\frac{1}{2}$ inches in width and $1\frac{3}{8}$ inches deep along the tongue portion. Lip portion 10*a* is constructed with a width of 1 inch. Insulation board materials of $\frac{1}{2}$ inches depth may be advantageously employed wih retaining means 10 having thedimensions above described. Of course, different dimensions may be used, the dimensions being dictated by the size of the roofing panels and the insulation board material.

Additional advantages of the retaining means of the present invention are apparent from the fact that once the insulation board material is secured in place, less heat will be transferred between the top of the panel and the space disposed beneath the insulation board. If insulation board were not used, aluminum roofing panels can become quite hot and radiate heat into a mobile home or the like. Thus, the insulation will prevent excessive heat buildup and thereby cut down on energy costs such as air conditioning, etc. The roof insulation retaining means of the present invention provides for fast, easy installment and removal of insulation material used beneath roof panels.

While the invention has been particularly shown and described with reference to the foregoing specific embodiments thereof, it will be understood by those skilled in the art that other changes in form and detail may be made therein without departing from the spirit and scope of the invention as defined in the appended claims.

What is claimed is:

1. An insulated roofing assembly comprising a. a plurality of sheet metal roofing panels forming a roof, each of said panels having a bottom generally flat surface, and each panel being joined to an adjacent panel at a joint, each joint including a portion of each roofing panel forming the joint extending upwardly away from and generally orthogonal to said bottom panel surfaces, each said upwardly extending portions being smooth-walled, b. a plurality of generally flat insulation panels disposed in generally abutting engagement with said roofing panel bottom surfaces, said insulation panels each having a bottom surface generally parallel to the bottom roofing panels surface, and c. means for readily removably retaining said insulation panels in engagement with said roofing panels so that said insulation panels may be readily assembled into engagement with said roofing panels and disassembled from engagement therewith, said means including a plurality of retaining members, each of said members comprising (i) a tongue portion inserted between the upstanding panel portions forming a joint between adjacent roofing panels, (ii) means formed on said tongue portion to provide sufficient withdrawal resistance of said tongue portion from said joint so that insulation panels may be supported by said retaining member while still allowing said tongue portion to be readily removable from said joint without damage to said joint or said tongue portion, (iii) a lip portion connected to said tongue portion and providing a support for an insulation panel by a utting the bottom surface thereof to hold said panel in engagement with a roofing panel bottom surface, and (iv) a withdrawal tab extending downwardly from said lip portion for aiding withdrawal of said tongue portion from a roofing panel joint in which it is disposed.

2. An assembly as recited in claim 1 wherein said means formed on said tongue portion to provide sufficient withdrawal resistance comprises a plurality of serrations formed on said tongue portion.

3. An assembly as recited in claim 1 wherein said lip portion of each of said retaining members comprises two segments, each segment being secured to said tongue portion and each segment being disposed about 180° from the other segment to enable said retaining member to support insulation panels on either side of said tongue portion.

4. Assembly as recited in claim 3 wherein said means formed on said tongue portion to provide sufficient withdrawal resistance comprises a plurality of serrations formed on said tongue portion.

* * * * *